United States Patent [19]

Nussbaumer et al.

[11] Patent Number: 4,623,198

[45] Date of Patent: Nov. 18, 1986

[54] METHOD FOR REDUCING COMPRESSED AIR LOSSES WHEN DRIVING UNDERGROUND CAVITIES SUPPORTED BY COMPRESSED AIR

[75] Inventors: Manfred Nussbaumer, Leonberg; Theo van Lith, Stuttgart, both of Fed. Rep. of Germany

[73] Assignee: Ed. Züblin Aktiengesellschaft, Stuttgart, Fed. Rep. of Germany

[21] Appl. No.: 602,185

[22] Filed: Apr. 19, 1984

[30] Foreign Application Priority Data

Apr. 21, 1983 [DE] Fed. Rep. of Germany ..... 3314549

[51] Int. Cl.[4] ..... E21C 37/06

[52] U.S. Cl. ..... 299/10; 299/11; 405/150

[58] Field of Search ..... 299/10, 11; 175/69, 175/71, 72; 405/150, 239

[56] References Cited

U.S. PATENT DOCUMENTS

| | | | |
|---|---|---|---|
| 3,394,758 | 7/1968 | Terry et al. | 175/71 |
| 3,612,192 | 10/1971 | Maguire, Jr. | 175/71 |
| 3,676,198 | 7/1972 | McGrourty | 405/150 |
| 3,724,565 | 4/1973 | Kelly, Jr. | 175/72 |
| 4,043,137 | 8/1977 | Jütte et al. | 405/150 |
| 4,237,182 | 12/1980 | Fulmer et al. | 405/150 |
| 4,261,670 | 4/1981 | Paban | 405/150 |
| 4,475,847 | 10/1984 | Cornely et al. | 299/11 |

OTHER PUBLICATIONS

Compositions and Properties of Oil Well Drilling Fluids by Rogers; 1948.

*Primary Examiner*—Stephen J. Novosad
*Assistant Examiner*—William P. Neuder
*Attorney, Agent, or Firm*—Becker & Becker, Inc.

[57] ABSTRACT

A method for reducing compressed air losses when driving underground cavities which are supported by compressed air. The part of the inner cavity face exposed by mining is sealed by a viscous medium after breaking away the earth. With a supply of propellant, the viscous medium is applied, in the form of a spray mist which is directed toward the exposed part of the inner cavity face, in such a way that the mist penetrates the substratum without substantially destroying the exposed face. Particles of rock are thus prevented from being detached from the face which is to be sealed.

17 Claims, 1 Drawing Figure

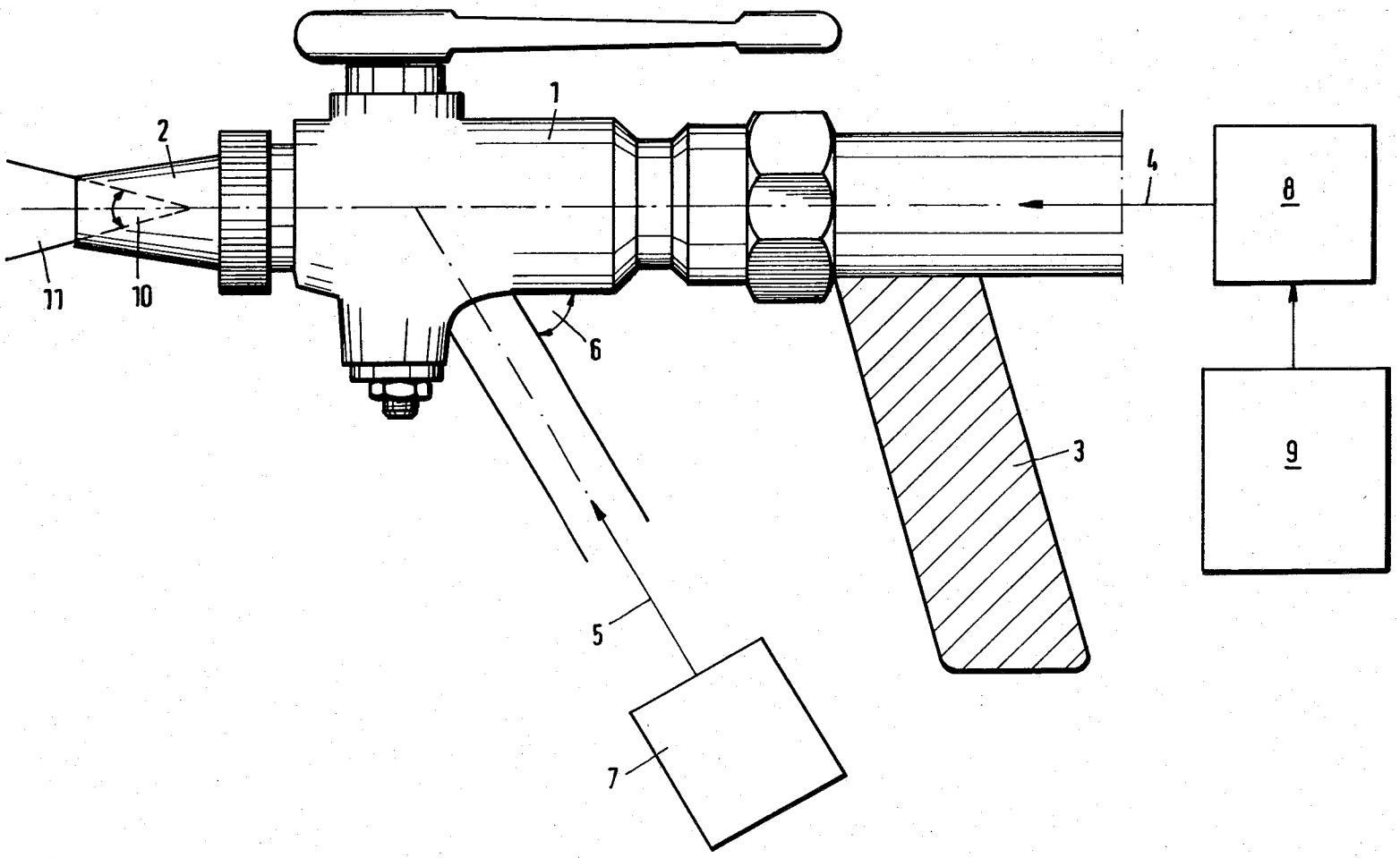
8
9
4
3
1
6
5
7
2
10
11

METHOD FOR REDUCING COMPRESSED AIR LOSSES WHEN DRIVING UNDERGROUND CAVITIES SUPPORTED BY COMPRESSED AIR

BACKGROUND OF THE INVENTION

1. Field of the Invention

The present invention relates to a method for reducing compressed air losses when driving underground cavities which are supported by compressed air; the part of the inner cavity surface exposed by mining is sealed by a viscous medium, such as a bentonite suspension, after breaking away the earth.

When building tunnels or galleries in loose rock, the pneumatic driving method is used. In this case, an earth-working apparatus mines the face which is formed by the exposed end face of the underground cavity. The earth-working apparatus operates in a compressed air chamber, which is sealed off by a protective shield and an associated partition. The compressed air chamber forms the intermediate member between the solid rock or earth and the finished tunnel cavity. The compressed air in the chamber between the face and the shield partition prevents penetration of water into the working chamber. However, depending on the nature of the solid earth, part of the supporting compressed air escapes through the face. Therefore, in the case of permeable earth, this results in a high consumption of compressed air.

2. Description of Prior Art

With one known method, the consumption of compressed air is reduced by sealing the face by spraying on a viscous medium, which is preferably a bentonite suspension. The viscous medium is applied as a membrane which is only several centimeters thick, and seals the pores between the individual grains of earth from the compressed air. In this case, a drawback is that the face which is to be sealed is frequently loosened and disturbed or even destroyed by being sprayed with the viscous medium, so that the sealing membrane is not fully effective.

In another known method, the face is sealed against escaping compressed air in that, in front of the face, a chamber is provided that is bounded by bulkheads and is completely filled with a bentonite suspension, which is then acted upon by compressed air. This method for sealing the face is, however, very complicated and expensive.

An object of the present invention is to provide a method whereby the face can be provided with a fully effective sealing membrane in a simple and economical manner, and in an unerring manner.

BRIEF DESCRIPTION OF THE DRAWING

This object, and other objects and advantages of the present invention, will appear more clearly from the following specification in conjunction with the accompanying drawing, which diagrammatically illustrates an apparatus for carrying out the method of the present invention.

SUMMARY OF THE INVENTION

The method of the present invention is characterized primarily in that the viscous medium is combined with a propellant and is applied, in the form of a spray mist which is directed onto the exposed part of the inner cavity surface, in such a way that the mist penetrates the substratum without significantly destroying the exposed surface.

With the method according to the present invention, an important improvement of the sealing technique of cut earth faces with respect to supporting compressed gases is achieved. The viscous medium no longer strikes with high pressure against the surface which is to be sealed; instead, the viscous medium is applied to the surface in the form of a spray mist. This prevents pieces of rock from being detached from the surface which is to be sealed, as a result of which the sealing membrane would be destroyed. The spray mist is deposited in sections on the surface which is to be sealed with substantially uniform density, and adheres to the surface. The membrane applied in this way primarily does not have a static, but rather a sealing effect.

Pursuant to further features of the present invention, compressed air may be used as the propellent. The spray mist may be applied to several different locations of the exposed part of the inner cavity surface at the same time. Prior to spraying, the propellant may be introduced at an angle into a stream of the viscous medium. This angle may be adjustable.

Additives, such as sawdust, may be added to the viscous medium, which is to be sprayed to adjust the viscosity thereof.

Deposition of the mist-like viscous medium may be promoted by artificial air circulation.

The viscous medium may have a plastic viscosity of up to about 30 cp, especially in a range of about 10 to 30 cp, and an apparent viscosity of up to about 50 cp, especially in a range of about 10 to 50 cp.

The viscous medium is preferably a bentonite suspension, and may comprise a mixture of dry powder and liquid mixed in a ratio in a range of between approximately 1:4 and 1:50, especially in the ratio in a range of between approximately 1:6 and 1:20.

The propellant may be supplied to the spray device at a pressure of up to approximately 8 bar, and the viscous medium may be supplied at a pressure of up to approximately 10 bar, preferably at a pressure in a range of between approximately 3 bar and 5 bar.

DESCRIPTION OF PREFERRED EMBODIMENTS

Referring now to the drawing in detail, a viscous medium 4, which is preferably a bentonite suspension, is sprayed by a known spray device 1 via supply of a propellant 5, preferably a propellant gas, and in particular compressed air. The bentonite suspension 4 is supplied via a pump 8 from a supply container 9 to one end of the spray device 1. Additionally, the suspension 4 is sucked into the spray device 1 by the supply of compressed air 5, which is supplied to the spray device 1 by an air compressor 7. The bentonite suspension 4 and the compressed air 5 mix together in the spray device 1. This mixture leaves the spray device through a nozzle 2. The spray mist 11 emerging from the spray device 1 is deposited at a substantially uniform thickness, and in sections, on the surface which is to be sealed, and forms a sealing membrane which adheres to the surface.

The angular aperture 10 of the nozzle 2 is preferably adjustable, so that the width of the spray mist 11 can be adapted to the relevant factors. The bentonite suspension stream or viscous medium 4 consequently may be sprayed so that the bentonite suspension is dispersed over a greater or lesser width. The angular aperture 10 can be adjusted in such a way that the spray mist 11 does not strike the surface which is to be sealed in too hard a manner, in order to prevent individual particles of the surface from breaking off. By adjusting the angular aperture 10 of the nozzle, the inventive method can be adapted to different types of rock in a simple manner. Furthermore, by adjusting the angular aperture 10, the distance between the spray nozzle 2 and the surface which is to be sealed can be varied, thus providing a further possibility of adaptation to the type of surface which is to be sealed.

The angle 6 at which the compressed air is introduced into the bentonite suspension stream or viscous medium 4, is preferably constant, so that the same mixing conditions are always guaranteed. However, due to the use of different spray devices or special constructions, the angle of introduction 6 also can be varied, so that an adaptation to the bentonite suspension stream or viscous medium 4 which is being used, and to the propellant 5 which is being used, is possible, in order to mix the latter to the desired extent.

The spray device 1 can be handled comfortably by a handle 3.

The deposition of the spray mist 11 on the surface which is to be sealed can be improved by the use of a fan with pressure in the direction of this surface. Moreover, the properties of the spray mist 11 may be varied by adding to the suspension additives which alter the viscosity, such as, for example, sawdust.

The bentonite suspension stream or viscous medium 4 is produced by mixing dry bentonite powder and a liquid in a ratio having a range of approximately 1:4 to approximately 1:50. At the time of spraying, the mixing ratio is preferably in a range of approximately 1:6 to approximately 1:20. It has been found that with these mixing ratios, the bentonite suspension stream or viscous medium 4 can be sprayed in an optimum manner. The suspension stream or viscous medium 4 is supplied to the spray device 1 with a pressure of up to approximately 10 bar, preferably in a pressure range between 3 bar and 5 bar. The propellant gas, which is preferably compressed air, is introduced into the spray device 1 at a pressure in a range of approximately 1 bar to approximately 8 bar.

The viscosity of the bentonite suspension may be up to approximately 30 cp for the plastic viscosity, and up to approximately 50 cp for the apparent viscosity (DIN 530/8, Part 1 and 2).

The spray device 1 is connected to an earth-working apparatus (not shown) to move with the apparatus, so that the sealant can be sprayed on immediately after the mining of the face. Remote control of the spray device 1 is also possible from outside the compressed gas chamber.

As a result of the aforedescribed possibilities of adjusting the viscosity, the angular aperture 10 of the nozzle, the spraying distance, and the pressure of the suspension and of the propellant gas, the spray mist 11 can be adjusted in such a way that, without any substantial destruction of the exposed face, the spray mist 11 penetrates the substratum of this face and thus enters into combination with the substratum. The deposition of the spray mist 11 on the surface also may be promoted by artificial air circulation.

The spray device 1 may have several nozzles for spraying the bentonite suspension stream or viscous medium 4, so that several spray mists can be applied to various locations of the exposed surface at the same time.

The present invention is, of course, in no way restricted to the specific disclosure of the specification and drawing, but also encompasses any modifications within the scope of the appended claims.

What we claim is:

1. In a method of reducing compressed air losses in a mining cavity formation when progressively driving underground cavities which are supported by compressed air, said method including the step of sealing part of an advancing cavity having an inner cavity surface exposed by mining and adding a viscous medium as a sealant layer applied in a step-wise manner according to advance of the cavity and also that the sealant layer does not add to the strength of the formation after breaking away the earth; the improvement therewith which comprises the steps of:

using viscous medium having a plastic viscosity of up to about 30 cp and having an apparent viscosity of up to about 50 cp;

combining said viscous medium with a propellant to form a mixture;

applying said mixture, in the form of a spray mist which is directed toward said exposed part of said inner cavity surface, in such a way that said mist penetrates the substratum without significantly destroying said exposed surface part;

moving said viscous medium continuously during advance of the underground cavity formation; and applying viscous medium in a renewed manner in sections corresponding to the advance.

2. A method according to claim 1, which includes the step of using a bentonite suspension as said viscous medium.

3. A method according to claim 1, which includes the step of using compressed air as said propellant.

4. A method according to claim 1, which includes the step of applying said spray mist mixture to several different locations of said exposed part of said inner cavity surface at the same time.

5. A method according to claim 1, in which said step of combining said viscous medium with a propellant includes the step of introducing said propellant into a stream of said viscous medium at an angle.

6. A method according to claim 5, in which said angle is adjustable.

7. A method according to claim 1, which includes the step of adding additive to said viscous medium to vary the viscosity thereof.

8. A method according to claim 7, which includes the step of using sawdust as said additive.

9. A method according to claim 1, which includes the step of promoting said step of applying said mixture via artificial air circulation.

10. A method according to claim 1, which includes the step of using viscous medium having a plastic viscosity in a range of from about 10 to about 30 cp.

11. A method according to claim 1, which includes the step of using viscous medium having an apparent viscosity in a range of from about 10 to about 50 cp.

12. A method according to claim 1, which includes the step of using a viscous medium which comprises a mixture of dry powder and liquid mixed in a ratio in a range of from between about 1:4 and about 1:50.

13. A method according to claim 12, in which said dry powder to liquid ratio is in a range of between about 1:6 and 1:20.

14. A method according to claim 1, which includes the steps of combining said viscous medium and said propellant in a spray device, and supplying said propellant to said spray device at a pressure of up to about 8 bar.

15. A method according to claim 14, which includes the step of supplying said propellant to said spray device at a pressure in a range of between about 1 to 8 bar.

16. A method according to claim 14, which includes the step of supplying said viscous medium to said spray device at a pressure of up to about 10 bar.

17. A method according to claim 16, which includes the step of supplying said viscous medium to said spray device at a pressure in a range of between about 3 to 5 bar.

* * * * *